US009617708B2

(12) United States Patent
Naik et al.

(10) Patent No.: US 9,617,708 B2
(45) Date of Patent: Apr. 11, 2017

(54) METHODS AND APPARATUS FOR CORRECTING A POSITION OF AN EXCAVATION VEHICLE USING TILT COMPENSATION

(71) Applicant: HONEYWELL INTERNATIONAL INC., Morristown, NJ (US)

(72) Inventors: Dinesh Naik, Karnataka (IN); Shridhara Shanbhogue, Karnataka (IN); Vijay Vasant Deshpande, Karnataka (IN); Pradeep Gollamahanti, Karnataka (IN); Kantha Urs, Karnataka (IN); Kantharaju T, Karnataka (IN); Vikram Vasantha Bhat, Karnataka (IN); M Vijaya Reddy, Karnataka (IN)

(73) Assignee: Honeywell International, Inc., Morris Plains, NJ (US)

( * ) Notice: Subject to any disclaimer, the term of this patent is extended or adjusted under 35 U.S.C. 154(b) by 0 days.

(21) Appl. No.: 14/870,312

(22) Filed: Sep. 30, 2015

(65) Prior Publication Data

US 2017/0037593 A1 Feb. 9, 2017

(30) Foreign Application Priority Data

Aug. 6, 2015 (IN) ..... 2416/DEL/2015

(51) Int. Cl.
*E02F 3/43* (2006.01)
*E02F 3/32* (2006.01)

(52) U.S. Cl.
CPC . *E02F 3/43* (2013.01); *E02F 3/32* (2013.01)

(58) Field of Classification Search
CPC . E02F 3/43; E02F 9/264; E02F 9/2029; E02F 9/265; E02F 3/845; E02F 3/435; E02F 3/769; G05B 13/026; A01D 33/10; B66C 23/905; B60J 5/0487; E03F 3/769
USPC ..... 701/50; 177/25.11; 37/408, 412; 700/275; 296/190.05; 414/572; 340/679
See application file for complete search history.

(56) References Cited

U.S. PATENT DOCUMENTS

| | | | | |
|---|---|---|---|---|
| 3,218,740 | A * | 11/1965 | White | E02F 3/769 172/701.1 |
| 3,431,016 | A * | 3/1969 | Eriksson | B60J 5/0487 296/190.05 |
| 3,859,651 | A | 1/1975 | Thomas, Jr. | |
| 4,360,308 | A * | 11/1982 | Gifford | A01D 33/10 367/96 |
| 4,889,466 | A | 12/1989 | Jindai et al. | |
| 5,116,186 | A | 5/1992 | Hanamoto et al. | |
| 5,499,684 | A | 3/1996 | Stratton | |
| 5,551,518 | A | 9/1996 | Stratton | |

(Continued)

FOREIGN PATENT DOCUMENTS

| | | | |
|---|---|---|---|
| JP | 11-131533 | A | 5/1999 |
| JP | 2000-303492 | A | 10/2000 |

*Primary Examiner* — Yuri Kan
(74) *Attorney, Agent, or Firm* — Conley Rose, P.C.; Kristin Jordan Harkins

(57) ABSTRACT

A method for correcting a position of an excavation vehicle, the excavation vehicle comprising a cab, a boom, a stick, and a bucket, is provided. The method detects vehicle tilt angle data; calculates tilt-compensated position output for the boom, based on a current boom angle and the detected vehicle tilt angle data; and adjusts the position, based on the tilt-compensated position output.

19 Claims, 10 Drawing Sheets

(56) References Cited

U.S. PATENT DOCUMENTS

| | | | | |
|---|---|---|---|---|
| 5,714,719 | A * | 2/1998 | Otsuka | E02F 9/264 177/141 |
| 5,799,419 | A | 9/1998 | Seo et al. | |
| 6,246,939 | B1 | 6/2001 | Nozawa | |
| 6,374,147 | B1 | 4/2002 | Rockwood | |
| 6,434,437 | B1 | 8/2002 | Brandt et al. | |
| 7,650,252 | B2 | 1/2010 | Douglas | |
| 7,844,379 | B2 | 11/2010 | Tang et al. | |
| 8,145,394 | B2 | 3/2012 | Chiorean et al. | |
| 8,204,653 | B2 | 6/2012 | Sahlin et al. | |
| 8,386,133 | B2 | 2/2013 | Sahlin et al. | |
| 8,620,534 | B2 | 12/2013 | Jessen et al. | |
| 8,726,543 | B2 * | 5/2014 | Kelly | E02F 9/2029 172/2 |
| 2012/0099955 | A1 * | 4/2012 | Glitza | E02F 3/435 414/687 |
| 2013/0158819 | A1 * | 6/2013 | Callaway | E02F 3/845 701/50 |
| 2014/0015685 | A1 * | 1/2014 | Wei | B66C 23/905 340/679 |
| 2014/0121840 | A1 * | 5/2014 | Mizuochi | E02F 9/265 700/275 |
| 2014/0297040 | A1 * | 10/2014 | Baba | G05B 13/026 700/275 |

* cited by examiner

METHODS AND APPARATUS FOR CORRECTING A POSITION OF AN EXCAVATION VEHICLE USING TILT COMPENSATION

CROSS-REFERENCE TO RELATED APPLICATION

This application claims the benefit of India Provisional Patent Application No. 2416/DEL/2015, filed Aug. 6, 2015, which is incorporated herein by reference.

TECHNICAL FIELD

Embodiments of the subject matter described herein relate generally to using tilt compensation to correct positioning of an excavation vehicle, such as a hydraulic excavator or other piece of heavy machinery. More particularly, embodiments of the subject matter relate to adjusting the output positions of the parts of an excavation vehicle based on vehicle tilt information.

BACKGROUND

Earth moving, excavation, and material handling equipment (e.g., excavation vehicles) are designed to dig below the ground surface on which the machine rests. Excavation vehicles may be used in loading, leveling, grading, lifting, trench/pit digging and backfilling, and other processes. The major components of the excavation vehicle are the boom, the stick (arm), and the bucket. Each cab, boom, stick, and bucket must be precisely positioned for accurate and safe operation, and position sensing devices may be used to accurately determine the positions of each of these parts. In addition, accurate positioning of the bucket tip for graded cutting operations requires closed loop monitoring of vehicle stability. This is due to the potential for toppling the vehicle should it begin operation outside of specified safety limits, to include maximum/minimum angular positions for each part. Currently, operation of an excavation vehicle includes the manual operation of separate tilt switches for each part, and the use of position measuring devices and laser feedback.

Accordingly, it is desirable to eliminate the need for separate switches, sensors, and laser feedback to safely operate an excavation vehicle. Furthermore, other desirable features and characteristics will become apparent from the subsequent detailed description and the appended claims, taken in conjunction with the accompanying drawings and the foregoing technical field and background.

BRIEF SUMMARY

Embodiments of the present invention provide a method for correcting a position of an excavation vehicle, the excavation vehicle comprising a cab, a boom, a stick, and a bucket. The method detects vehicle tilt angle data; calculates tilt-compensated position output for the boom, based on a current boom angle and the detected vehicle tilt angle data; and adjusts the position, based on the tilt-compensated position output.

Some embodiments provide a system for correcting position of an excavation vehicle, the excavation vehicle comprising a cab, a boom, a stick, and a bucket. The system includes: a position detection module, configured to identify a current boom angle and a current vehicle tilt angle; a position analysis module, configured to calculate tilt-corrected position data for the boom, based on the current boom angle and the current vehicle tilt angle; and a position correction module, configured to initiate adjustment of the position of the excavation vehicle, based on the tilt-corrected position data for the boom.

Some embodiments provide a boom tilt device associated with correcting position of an excavation vehicle comprising a cab, a boom, a stick, and a bucket, the boom tilt device comprising: a vehicle tilt sensor, configured to detect a vehicle tilt angle; a boom angle position sensor, configured to detect a boom angle position; processing logic, configured to: identify dimension data associated with parts of the excavation vehicle, the parts comprising the cab, the boom, the bucket, and the stick; and calculate tilt-compensated boom position output, based on the vehicle tilt angle and the boom angle position; and a boom control element, configured to shift the boom, based on the tilt-compensated boom position output.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

The following detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any expressed or implied theory presented in the preceding technical field, background, brief summary or the following detailed description.

The subject matter presented herein relates to apparatus and methods used to automatically adjust positioning of an excavation vehicle to maintain accurate and safe operation. Current vehicle tilt is detected and used to calculate tilt-compensated positions associated with the parts of an excavation vehicle (e.g., cab, boom, stick, and bucket), and each part is automatically adjusted, using the calculated tilt-compensated position data. In certain embodiments, each of the cab, boom, stick, and bucket are equipped with position sensors, and a boom position sensor retrieves vehicle tilt data, calculated a tilt-compensated boom position, and provides the vehicle tilt data and the tilt-compensated boom position as outputs for use by a stick position sensor and a bucket position sensor. In some embodiments, the boom position sensor utilizes a dual-frequency pulse width modulation (PWM) signal to transmit both output signals using one output line.

Figure 1:
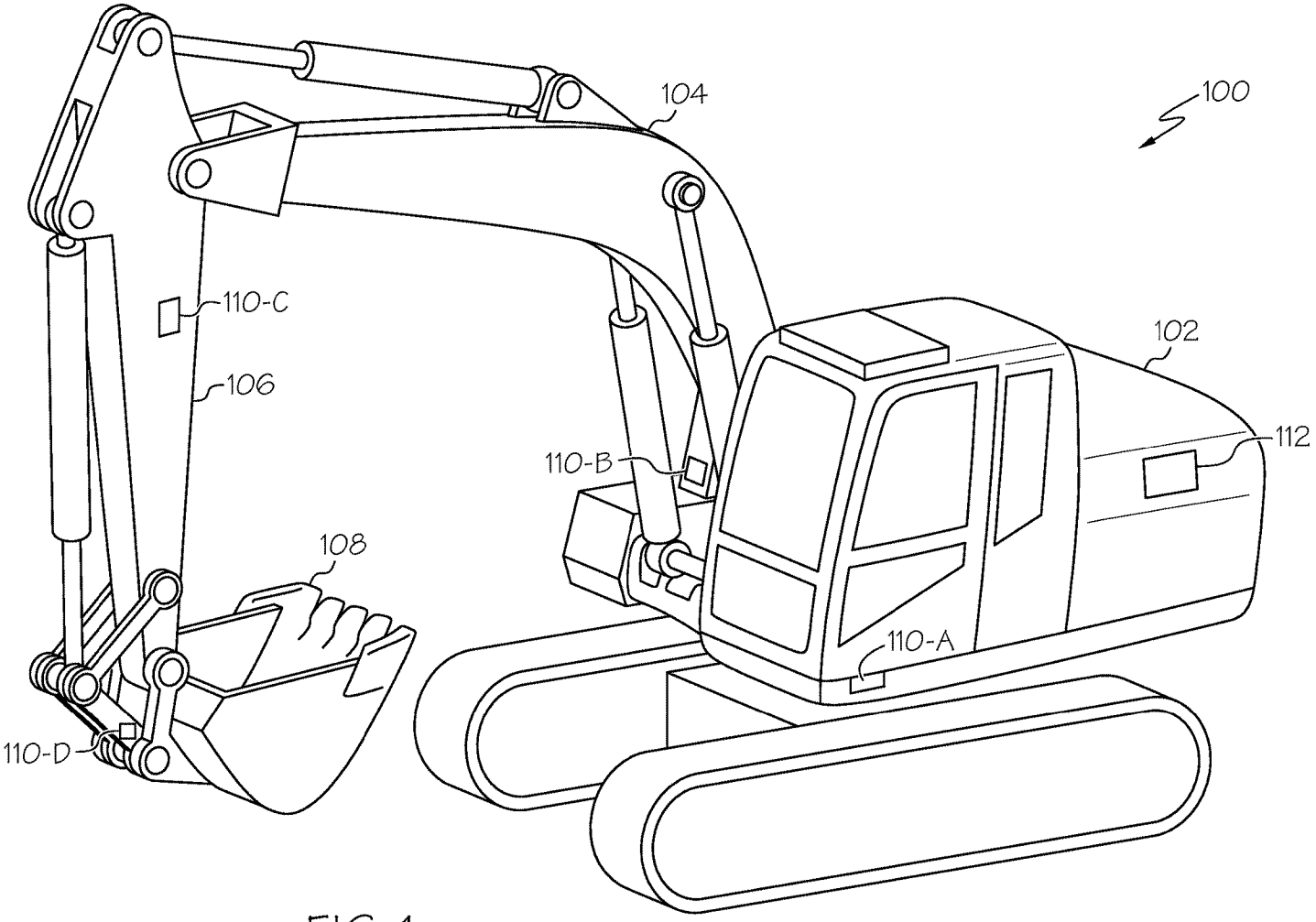
FIG. 1 is a diagram of an excavation vehicle, in accordance with the disclosed embodiments.

Turning now to the figures, FIG. 1 is a diagram of an excavation vehicle 100, in accordance with the disclosed embodiments. The excavation vehicle 100 may be any standard model excavator, digger, steam shovel, mechanical shovel, tracked excavator, hydraulic excavator, or hydraulic hoe operable to dig below the ground surface on which the machine rests. The excavation vehicle 100 comprises a plurality of component parts to include, without limitation: a cab 102, a boom 104, a stick 106, and a bucket 108. The excavation vehicle 100 uses a tilt-compensation system for purposes of adjusting the positioning of each of the component parts. Each component part of the excavation vehicle 100 is associated with one of a group of position sensors 110. As shown, the cab 102 is associated with cab position sensor 110-A; the boom 104 is associated with boom position sensor 110-B; the stick 106 is associated with stick position sensor 110-C; and the bucket 108 is associated with bucket position sensor 110-D. Each of the position sensors 110 functions to provide angular position data for each associated component part of the excavation vehicle 100; to calculate corrected position data for each component part, based on vehicle tilt; and to provide one or more output signals used to adjust positioning of its associated component part of the excavation vehicle 100.

The excavation vehicle 100 also generally includes a vehicle electronic control unit (ECU) 112, capable of performing calculations, storing vehicle data, and communicating with the position sensors 110 to transmit and receive data. Data received by the ECU 112 may include current position data for each of the cab 102, boom 104, stick 106, and/or bucket 108, current vehicle tilt data, and diagnostics signals indicating operation outside of predefined limits. Transmitted data may include tilt-compensated position data for each of the cab 102, boom 104, stick 106, and/or bucket 108.

In certain embodiments, the boom position sensor 110-B detects vehicle tilt angle data, which is used by the boom position sensor 110-B to calculate a tilt-compensated boom position. In some embodiments, the boom position sensor 110-B may communicate with the ECU 112 to provide tilt-compensated position output, which may be used by the ECU 112 in calculating tilt-compensated position data for each of the cab 102, stick 106, and/or bucket 108. In some embodiments, the boom position sensor 110-B may be further configured to communicate with the cab position sensor 110-A, the stick position sensor 110-C, and the bucket position sensor 110-D to provide tilt-compensated position output. Here, tilt-compensated position output is used by the cab position sensor 110-A to calculate a tilt-compensated cab 102 position, by the stick position sensor 110-C to calculate a tilt-compensated stick 106 position, and by the bucket position sensor 110-D to calculate a tilt-compensated bucket 108 position.

Figure 2:
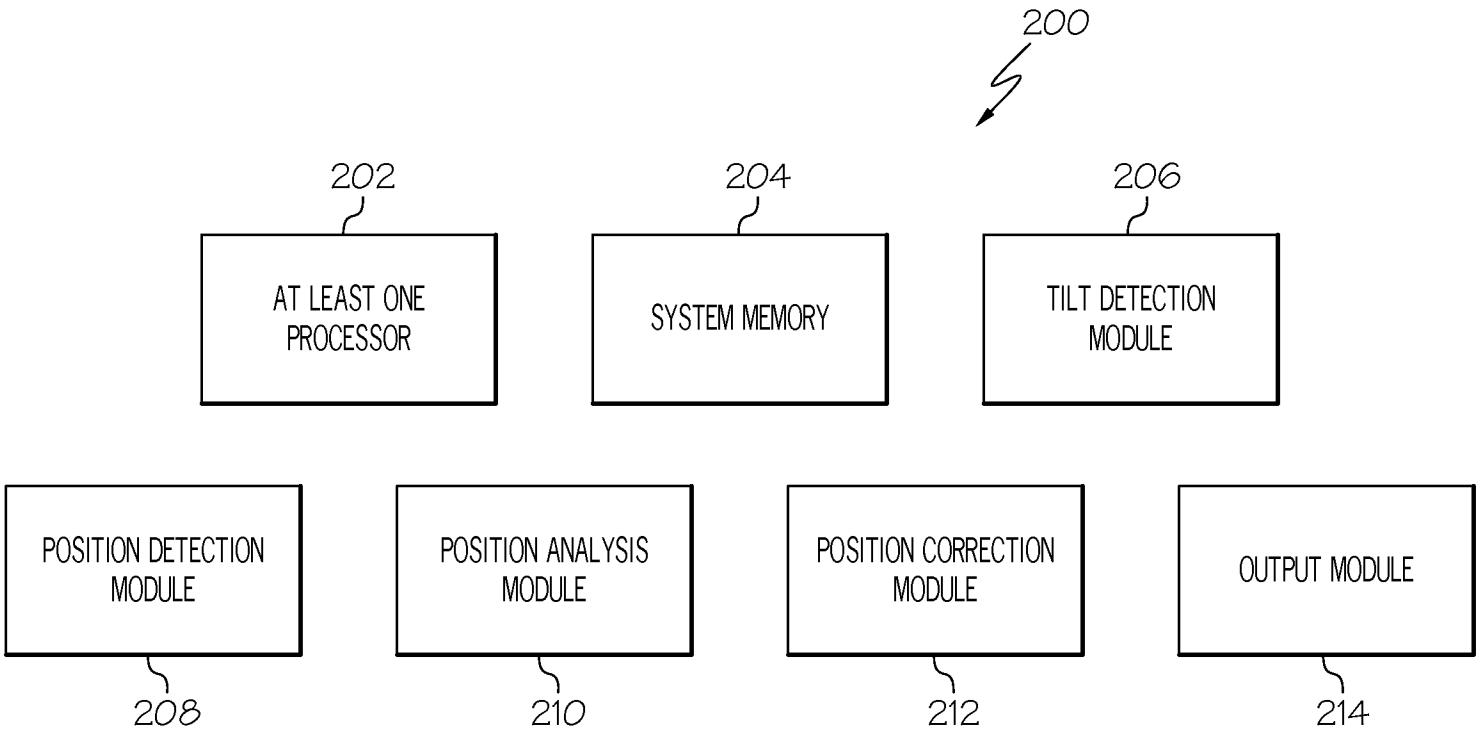
FIG. 2 is a functional block diagram of a tilt-compensation system, in accordance with the disclosed embodiments.

FIG. 2 is a functional block diagram of a tilt compensation system 200, in accordance with the disclosed embodiments. The tilt compensation system 200 includes, without limitation: at least one processor 202; system memory 204; a tilt detection module 206; a position detection module 208; a position analysis module 210; a position correction module 212; and an output module 214. These elements and features of the tilt compensation system 200 may be operatively associated with one another, coupled to one another, or otherwise configured to cooperate with one another as needed to support the desired functionality—in particular, calculating and using precise positioning of the parts of an excavation vehicle for operability, while compensating for an existing vehicle tilt angle, as described herein. For ease of illustration and clarity, the various physical, electrical, and logical couplings and interconnections for these elements and features are not depicted in FIG. 2. Moreover, it should be appreciated that embodiments of the tilt compensation system 200 will include other elements, modules, and features that cooperate to support the desired functionality. For simplicity, FIG. 2 only depicts certain elements that relate to the tilt-compensation techniques described in more detail below.

The at least one processor 202 may be implemented or performed with one or more general purpose processors, a content addressable memory, a digital signal processor, an application specific integrated circuit, a field programmable gate array, any suitable programmable logic device, discrete gate or transistor logic, discrete hardware components, or any combination designed to perform the functions described here. In particular, the at least one processor 202 may be realized as one or more microprocessors, controllers, microcontrollers, or state machines. Moreover, the at least one processor 202 may be implemented as a combination of computing devices, e.g., a combination of digital signal processors and microprocessors, a plurality of microprocessors, one or more microprocessors in conjunction with a digital signal processor core, or any other such configuration.

The system memory 204 may be realized using any number of devices, components, or modules, as appropriate to the embodiment. In practice, the system memory 204 could be realized as RAM memory, flash memory, EPROM memory, EEPROM memory, registers, a hard disk, a removable disk, or any other form of storage medium known in the art. In certain embodiments, the system memory 204 includes a hard disk, which may also be used to support functions of the at least one processor 202. The system memory 204 can be coupled to the at least one processor 202 such that the at least one processor 202 can read information from, and write information to, the system memory 204. In the alternative, the system memory 204 may be integral to the at least one processor 202. As an example, the at least one processor 202 and the system memory 204 may reside in a suitably designed application-specific integrated circuit (ASIC).

The tilt detection module 206 is configured to retrieve a current vehicle tilt angle. In some embodiments, the tilt detection module 206 communicates with a boom position sensor to detect the current vehicle tilt angle. In other embodiments, the tilt detection module 206 communicates with other vehicle position sensors to obtain the vehicle tilt angle. For example, the vehicle tilt angle may be detected by a standalone vehicle tilt sensor. Vehicle tilt may be defined as the angle of elevation of an excavator vehicle, when the vehicle is not resting on a level surface. The tilt detection module 206 may acquire the vehicle tilt angle data from a vehicle tilt sensor that includes accelerometers, gyroscopes, or any other hardware element configured to detect vehicle tilt.

The position detection module 208 is configured to communicate with a boom position sensor to detect an angular position for the boom. The position detection module 208 is further configured to communicate with a stick position sensor to detect an angular position for the stick, and a bucket position sensor to detect an angular position for the bucket. Generally, angular position data is provided by an array of anisotropic magneto resistive (AMR) sensors upon detection of a target magnetic vector change. Angular positions for the component parts of an excavation vehicle are used to ensure operability of the excavator and safe conditions in the operation of the excavator. Safety limits for operation of the excavation vehicle include maximum and minimum angular positions for each part, and the position detection module 208 provides current angular position data to the tilt compensation system 200 for further analysis.

The position analysis module 210 is configured to use dimension data and current position data for the component parts of the excavation vehicle to calculate tilt-compensated positions for each of the component parts. Here, a tilt-compensated position for a part indicates an angular position at which the part should be arranged in order to operate the excavation vehicle safely at the current vehicle tilt angle.

The position analysis module 210 is configured to retrieve, and use in calculations, dimension data for the boom, the stick, the bucket, and a swing link. Dimension data may include a measured length, width, and/or height measurements for each component part. In certain exemplary embodiments, the lengths of component parts of an excavation vehicle are used in tilt-compensation calculations.

The position analysis module 210 is further configured to obtain angular position data (via the position detection module 208) for each component part, and to use the retrieved angular positions in calculations. Angular position data may be obtained at timed intervals or according to an event-driven schedule. For example, in the first case, angular position data may be obtained every 800 μS. As another example, angular position data may be obtained when movement of any particular vehicle component is detected.

Figure 3:
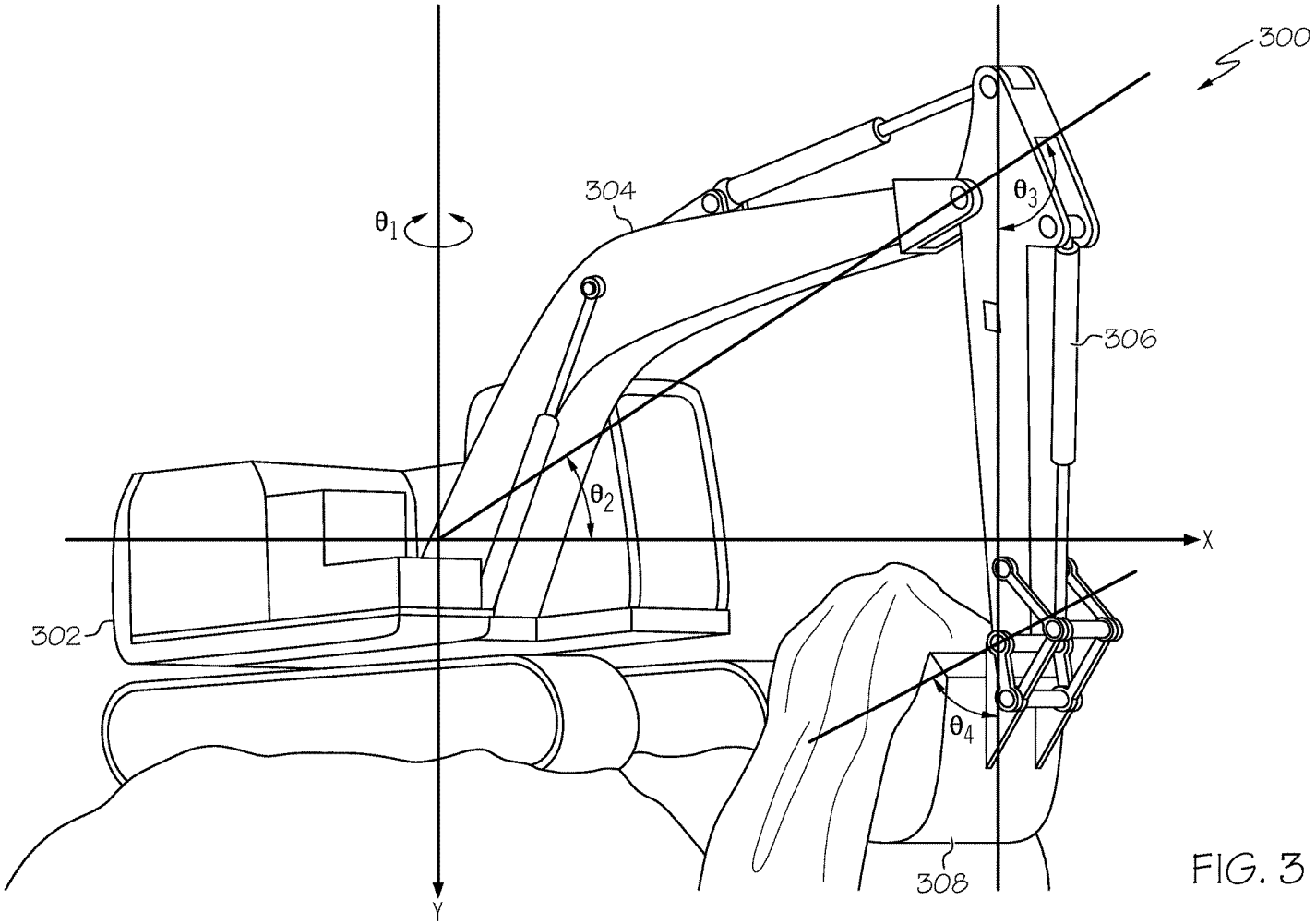
FIG. 3 is a diagram of angular positions of the component parts of an excavation vehicle, in accordance with the disclosed embodiments.

In one exemplary embodiment, angular positions for each component part of an excavation vehicle are illustrated in FIG. 3. An excavation vehicle 300 is shown, which includes a cab 302, a boom 304, a stick 306, and a bucket 308. Here, a first angle $\theta_1$ indicates the swing angle of the cab 302 around a vertical y-axis, with respect to a level surface. A second angle $\theta_2$ indicates the boom angle, or in other words, angular position of the boom 304. A third angle $\theta_3$ indicates angular position of the stick 306, and a fourth angle $\theta_4$ indicates angular position of the bucket 308. (Reference axis OB is indicated in the below-described FIG. 8, as it applies to stick angle $\theta_3$ and bucket angle $\theta_4$.)

Figure 4A:
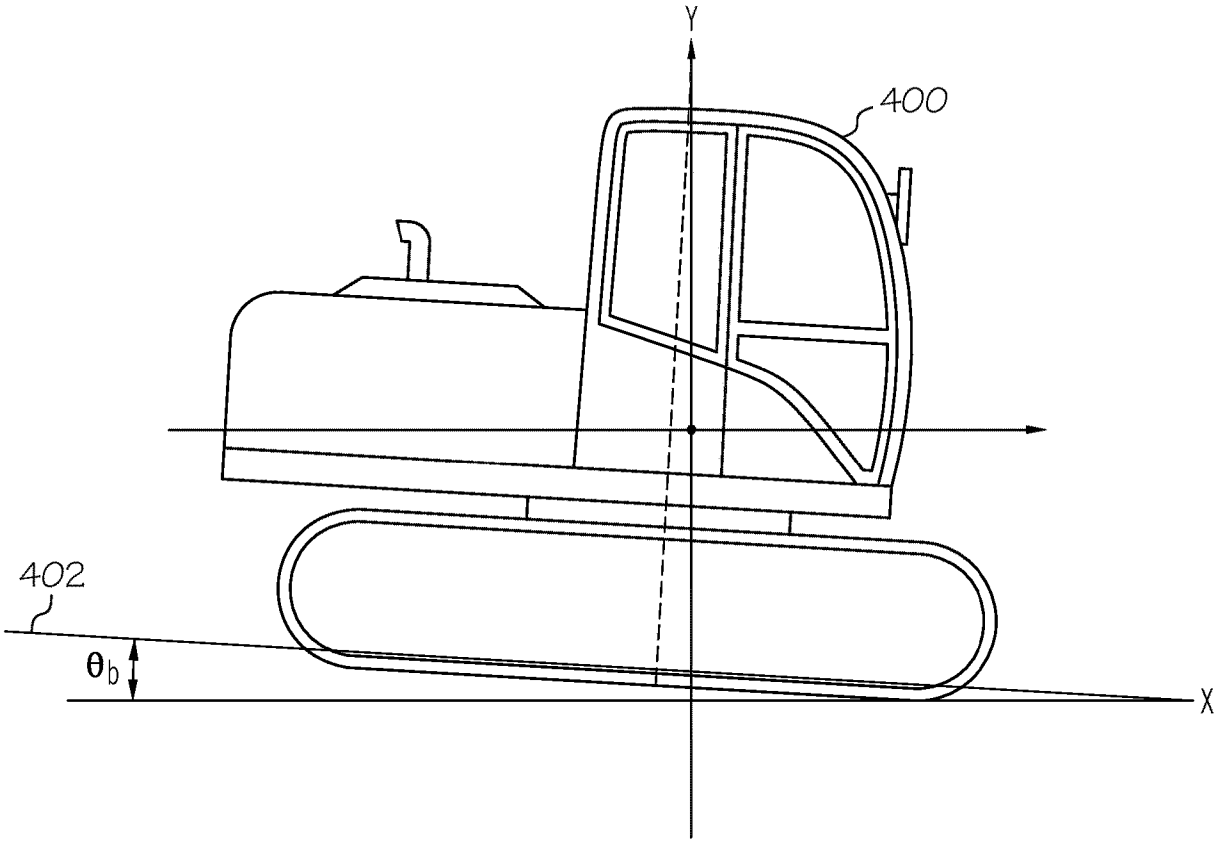
FIGS. 4A and 4B are diagrams of an excavation vehicle at a particular vehicle tilt angle, in accordance with the disclosed embodiments.
Figure 4B:
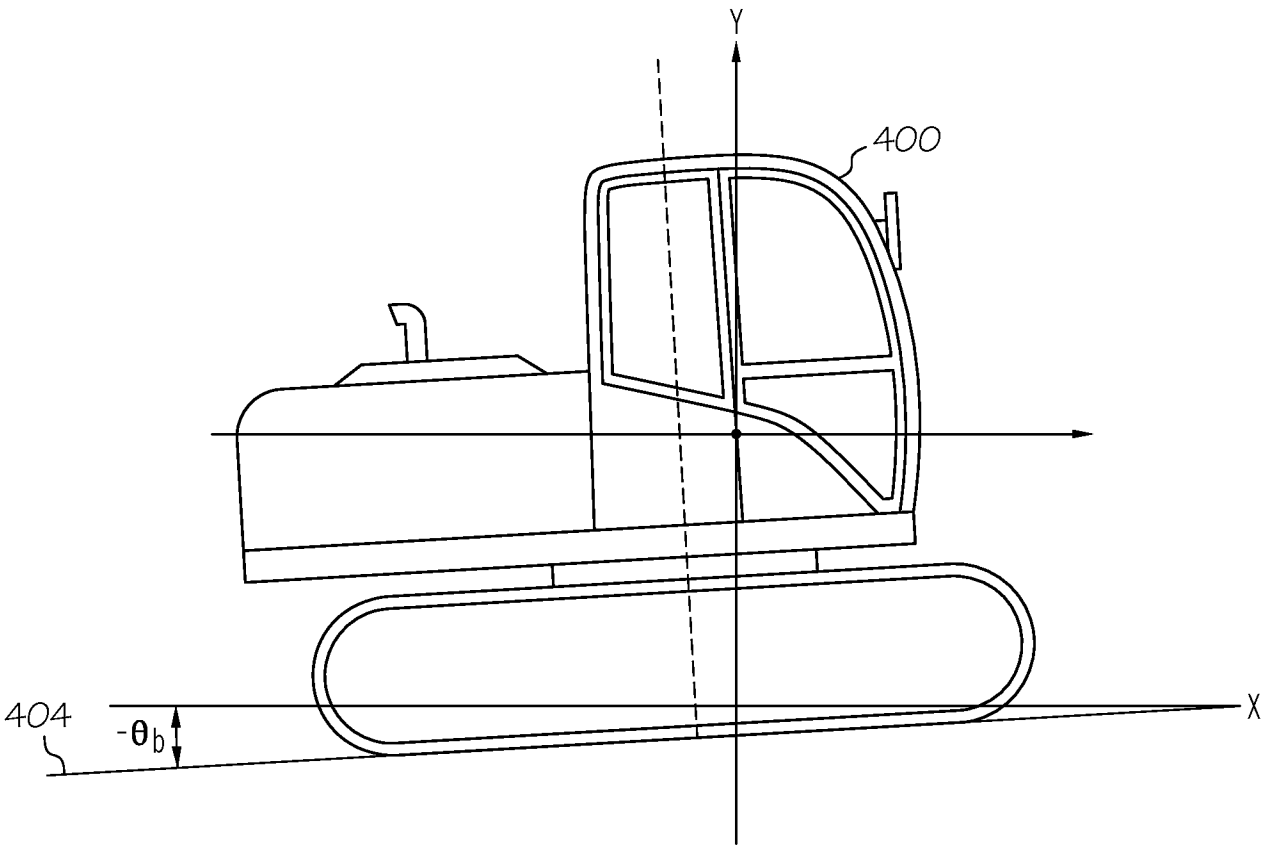

Returning to FIG. 2, the position analysis module 210 is also configured to obtain a current vehicle tilt angle (via the position detection module 208) for the excavation vehicle, and to use the retrieved vehicle tilt angle in calculations. An exemplary embodiment of vehicle tilt for an excavation vehicle is shown in FIGS. 4A and 4B. In FIG. 4A, the excavator vehicle 400 is resting on a surface 402 that is not level, and the direction of travel is "downhill". The surface 402 exists at an angle $\theta_b$ from the flat surface represented by the x-axis. Here, angle $\theta_b$ represents "vehicle tilt" for the excavator vehicle 400 in a downhill scenario. In FIG. 4B, the excavator vehicle 400 is resting on surface 404 that is also not level, and the direction of travel is "uphill". Here, the surface 404 exists at a negative angle ($-\theta_b$) from the flat surface represented by the x-axis. The negative angle $-\theta_b$ represents "vehicle tilt" for the excavator vehicle 400 in the uphill scenario.

Returning to FIG. 2, the position analysis module 210 uses the current angular positions of the component parts of an excavation vehicle, known dimensions of the component parts, and a current vehicle tilt angle to calculate appropriate operating positions for each of the component parts at the current vehicle tilt angle. In other words, the position analysis module 210 calculates tilt-compensated positions for each of the boom, stick, and bucket.

In practice, the position analysis module 210 may be implemented with (or cooperate with) the at least one processor 202 to perform at least some of the functions and operations described in more detail herein. In this regard, the position analysis module 210 may be realized as suitably written processing logic, application program code, or the like.

The position correction module 212 is configured to obtain calculated tilt-compensated angular position data (via the position analysis module 210), and to communicate with the appropriate hardware of the excavation vehicle to initiate movement of each component part from a current position to a calculated, tilt-compensated position. The position correction module 212 is further configured to generate and provide appropriate control instructions, commands, or signals to initiate these corrective adjustments.

The output module 214 is configured to transmit or provide one or more output signals for use by position sensors of an excavation vehicle. In certain embodiments, the output module 214 may provide tilt-corrected position data (calculated by the position analysis module 210) and/or vehicle tilt data. Tilt-corrected (i.e., tilt-compensated) position data may include a tilt-corrected boom position, a tilt-corrected stick position, and/or a tilt-corrected bucket position.

The output module 214 may use any communication equipment and protocol appropriate to an excavation vehicle. In certain embodiments, the output module 214 uses hardware compatible with a controller area network (CAN) protocol. In some embodiments, the output module 214 uses hardware compatible with a pulse width modulation (PWM) protocol. (The CAN and PWM communication protocols are well-known in the art and will not be described in detail here.) In an exemplary embodiment, the output module 214 uses a dual-frequency PWM signal to transmit tilt-corrected position data via a first frequency and vehicle tilt data via a second frequency.

The output module 214 is further configured to transmit a diagnostics signal, or a warning signal, when the excavation vehicle operates outside of a specified safety limit. Safety limits may include minimum and/or maximum angular positions for the component parts of the excavation vehicle, a maximum allowable vehicle tilt, or the like. Safety limits are generally field programmable based on vehicle type. When safety limits are exceeded, then a vehicle electronic control unit (ECU) will be notified with a warning signal and then ECU may take further action based on this safety alert.

Figure 5:
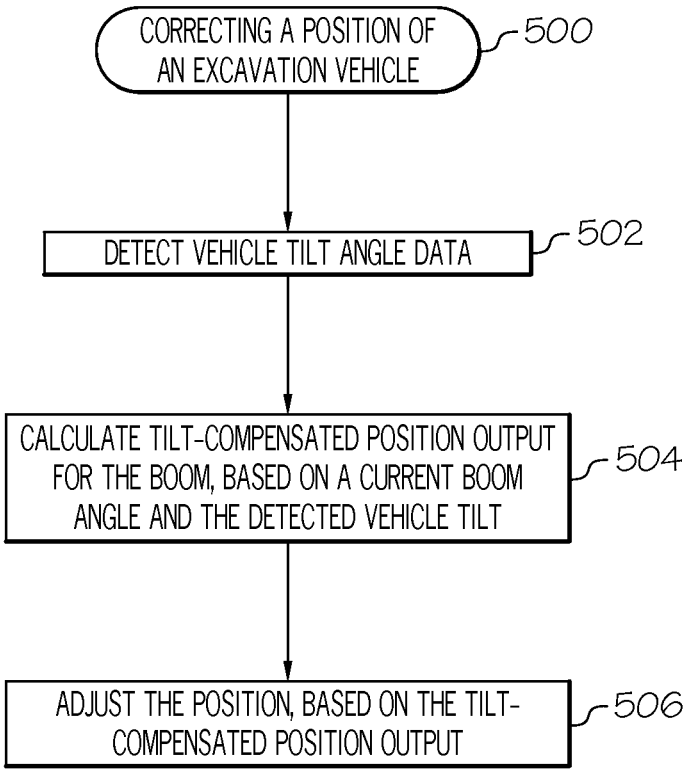
FIG. 5 is a flow chart that illustrates an embodiment of a process for correcting a position of an excavation vehicle.

FIG. 5 is a flow chart that illustrates an embodiment of a process 500 for correcting a position of an excavation vehicle. The various tasks performed in connection with process 500 may be performed by software, hardware, firmware, or any combination thereof. For illustrative purposes, the following description of process 500 may refer to elements mentioned above in connection with FIGS. 1-4. In practice, portions of process 500 may be performed by different elements of the described system, e.g., one or more excavation vehicle position sensors, a vehicle electronic control unit (ECU), or any combination of hardware components onboard an excavation vehicle. It should be appreciated that process 500 may include any number of additional or alternative tasks, the tasks shown in FIG. 5 need not be performed in the illustrated order, and process 500 may be incorporated into a more comprehensive procedure or process having additional functionality not described in detail herein. Moreover, one or more of the tasks shown in FIG. 5 could be omitted from an embodiment of the process 500 as long as the intended overall functionality remains intact.

First, the process 500 detects vehicle tilt angle data (step 502), by requesting vehicle tilt data from a vehicle tilt sensor. Vehicle tilt sensors may include accelerometers, gyroscopes, or any other sensor capable of providing orientation data associated with the excavator vehicle. In certain embodiments, the vehicle tilt sensor is an integrated element of a boom position sensor, and vehicle tilt angle data is provided by the boom position sensor as either a standalone vehicle tilt value, a tilt-compensated boom position angle (which has been calculated using the detected vehicle tilt angle), or a combination of both.

Next, the process 500 calculates tilt-compensated position output for the boom, based on a current boom angle and the detected vehicle tilt (step 504). Here, the current boom angle is the current angular position of the boom, prior to any adjustment or correction. Tilt-compensated position output for the boom generally includes a tilt-compensated boom position and vehicle tilt data. The tilt-compensated boom position is a calculated angular position or arrangement of the boom which is required for the excavation vehicle to operate safely. In certain embodiments, to calculate the tilt-compensated position output for the boom, the process 500 subtracts a forward vehicle tilt angle from the current boom angle and adds a backward vehicle tilt angle to the current boom angle, to create the second boom angle. Here, the tilt-compensated position output comprises the second boom angle. Using the detected vehicle tilt angle data (as shown and described previously with regard to FIG. 3), the process 500 computes a tilt-compensated boom position (i.e., the second boom angle), at which the boom of the excavation vehicle may safely operate, at the current angle of vehicle tilt.

In certain embodiments, the process 500 communicates the calculated tilt-compensated position output for the boom, for use in calculations by an excavation vehicle ECU or by another position sensor associated with another component part of the excavation vehicle. Here, when the tilt-compensated position output comprises a tilt-corrected boom angle and a vehicle tilt angle, the process 500 may communicate the tilt-corrected boom angle via a first frequency and the vehicle tilt angle via a second frequency, utilizing a dual-frequency pulse width modulation (PWM) signal to transmit both of the first frequency and the second frequency. In another case, when the tilt-compensated position output comprises a current boom angle and the vehicle tilt angle, the process 500 may communicate the current boom angle via a first frequency and the vehicle tilt angle via a second frequency, again utilizing a dual-frequency PWM signal to transmit both of the first frequency and the second frequency.

The process 500 then adjusts the position, based on the tilt-compensated position output (step 506). One suitable methodology for adjusting the position, based on the tilt-compensated position output is described below with reference to FIG. 6. Adjusting the position of the excavation vehicle may include adjustment or correction of a single component, or adjustment of a combination of components. Components may include, without limitation: the cab, the boom, the stick, and/or the bucket of the excavation vehicle.

Figure 6:
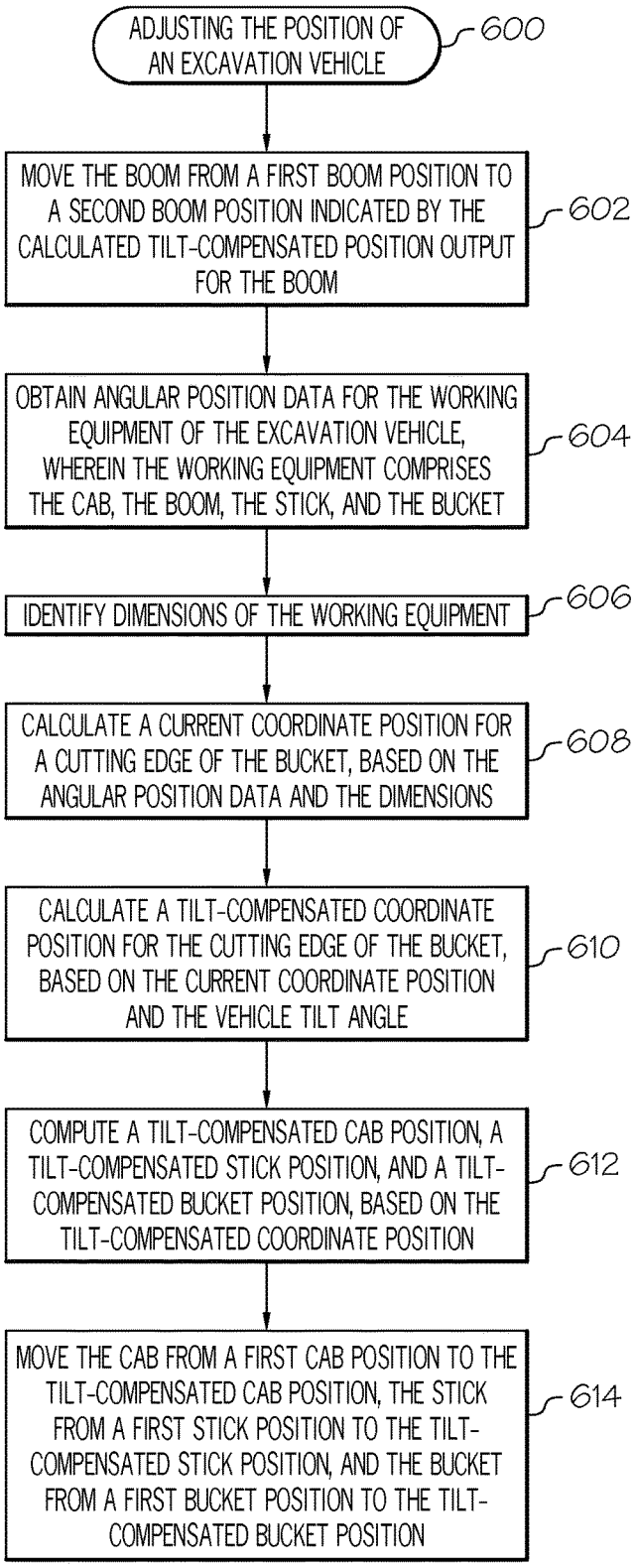
FIG. 6 is a flow chart that illustrates an embodiment of a process for adjusting the position of an excavation vehicle.

FIG. 6 is a flow chart that illustrates an embodiment of a process for adjusting the position of an excavation vehicle. It should be appreciated that the process 600 described in FIG. 6 represents one embodiment of step 506 described above in the discussion of FIG. 5, including additional detail. First, the process 600 moves the boom from a first boom position to a second boom position indicated by the calculated tilt-compensated position output for the boom (step 602).

Next, the process 600 obtains angular position data for the working equipment of the excavation vehicle, wherein the working equipment comprises the cab, the boom, the stick, and the bucket (step 604). Current angular position data is generally requested by the process 600 from position sensors associated with each of the cab, the stick, and the bucket. However, in certain embodiments, the angular position data may be transmitted from each position sensor without requiring a request. For example, a stick position sensor may automatically determine an angular position for the stick at timed intervals, and provide the angular position data for the stick each time it is determined. In other embodiments, the angular position data may be retrieved for a component part of the excavation vehicle and transmitted automatically when the angular position data falls outside of predetermined safety limits (e.g., maximum or minimum allowable angular positions for a component part).

The process 600 then identifies dimensions of the working equipment of the excavation vehicle (step 606). Dimension values for each of the cab, the boom, the stick, and the bucket are particular to each excavation vehicle, and are generally stored onboard for retrieval. Dimension data may be retrieved by a position sensor associated with a component part of the excavation vehicle (e.g., boom, stick, or bucket), or it may be retrieved by a vehicle ECU.

Figure 7:
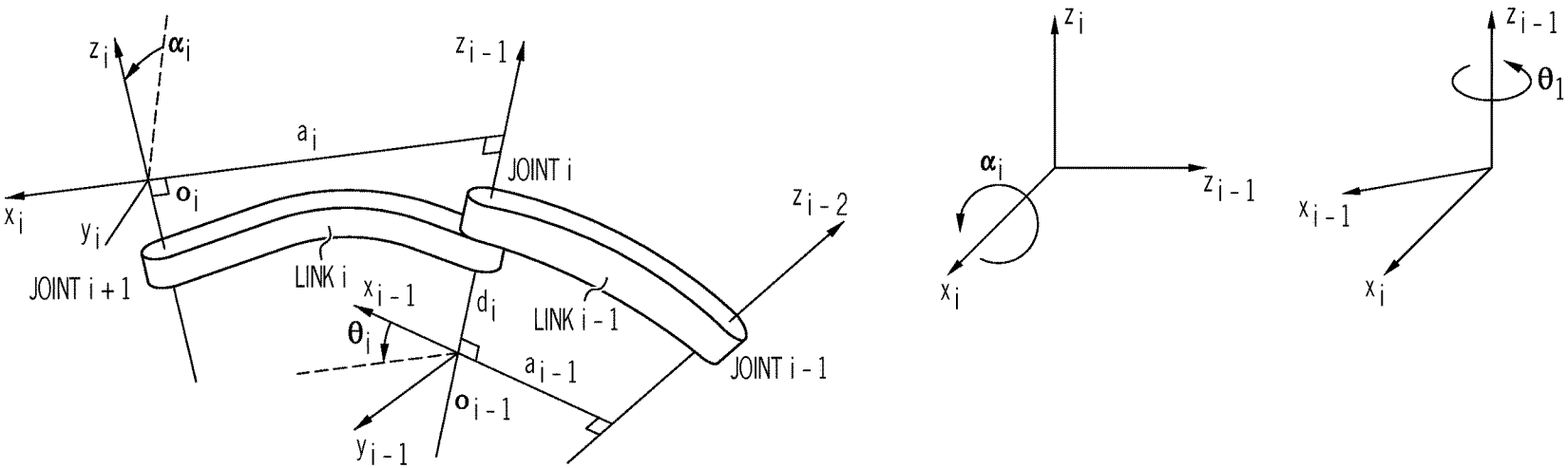
FIG. 7 is a diagram representation of a mathematical relationship between component parts of an excavation vehicle, in accordance with the disclosed embodiments.

Next, the process 600 calculates a current coordinate position for a cutting edge of the bucket, based on the angular position data and the dimensions (step 608). The process 600 begins these calculations by referencing a Denavit-Hartenberg representation to relate two adjacent reference frames, as shown in FIG. 7, and the associated equations below:

$$A_i = Rot_{z,\theta_i} Trans_{z,d_i} Trans_{x,a_i} Rot_{x,\alpha_i}$$

$$= \begin{bmatrix} C_{\theta_i} & -s_{\theta_i} & 0 & 0 \\ s_{\theta_i} & c_{\theta_i} & 0 & 0 \\ 0 & 0 & 1 & 0 \\ 0 & 0 & 0 & 1 \end{bmatrix} \begin{bmatrix} 1 & 0 & 0 & 0 \\ 0 & 1 & 0 & 0 \\ 0 & 0 & 1 & d_i \\ 0 & 0 & 0 & 1 \end{bmatrix} \begin{bmatrix} 1 & 0 & 0 & a_i \\ 0 & 1 & 0 & 0 \\ 0 & 0 & 1 & 0 \\ 0 & 0 & 0 & 1 \end{bmatrix} \begin{bmatrix} 1 & 0 & 0 & 0 \\ 0 & c_{\alpha_i} & -s_{\alpha_i} & 0 \\ 0 & s_{\alpha_i} & c_{\alpha_i} & 0 \\ 0 & 0 & 0 & 1 \end{bmatrix}$$

$$= \begin{bmatrix} c_{\theta_i} & -s_{\theta_i} c_{\alpha_i} & s_{\theta_i} s_{\alpha_i} & a_i c_{\theta_i} \\ s_{\theta_i} & c_{\theta_i} c_{\alpha_i} & -c_{\theta_i} s_{\alpha_i} & a_i s_{\theta_i} \\ 0 & s_{\alpha_i} & c_{\alpha_i} & d_i \\ 0 & 0 & 0 & 1 \end{bmatrix}$$

Here, the quantities $a_i$, $a_i$, $d_i$, and $\theta_i$ are parameters associated with link i and joint i. The four parameters $a_i$, $a_i$, $d_i$, and $\theta_i$ are usually termed link length, link twist, link offset, and joint angle, respectively. Because the matrix $A_i$ is a function of a single variable, three of the four parameters are constant for a given link, while the fourth parameter ($\theta_i$ for a revolute joint and $d_i$ for a prismatic joint) is the joint variable.

Figure 8:
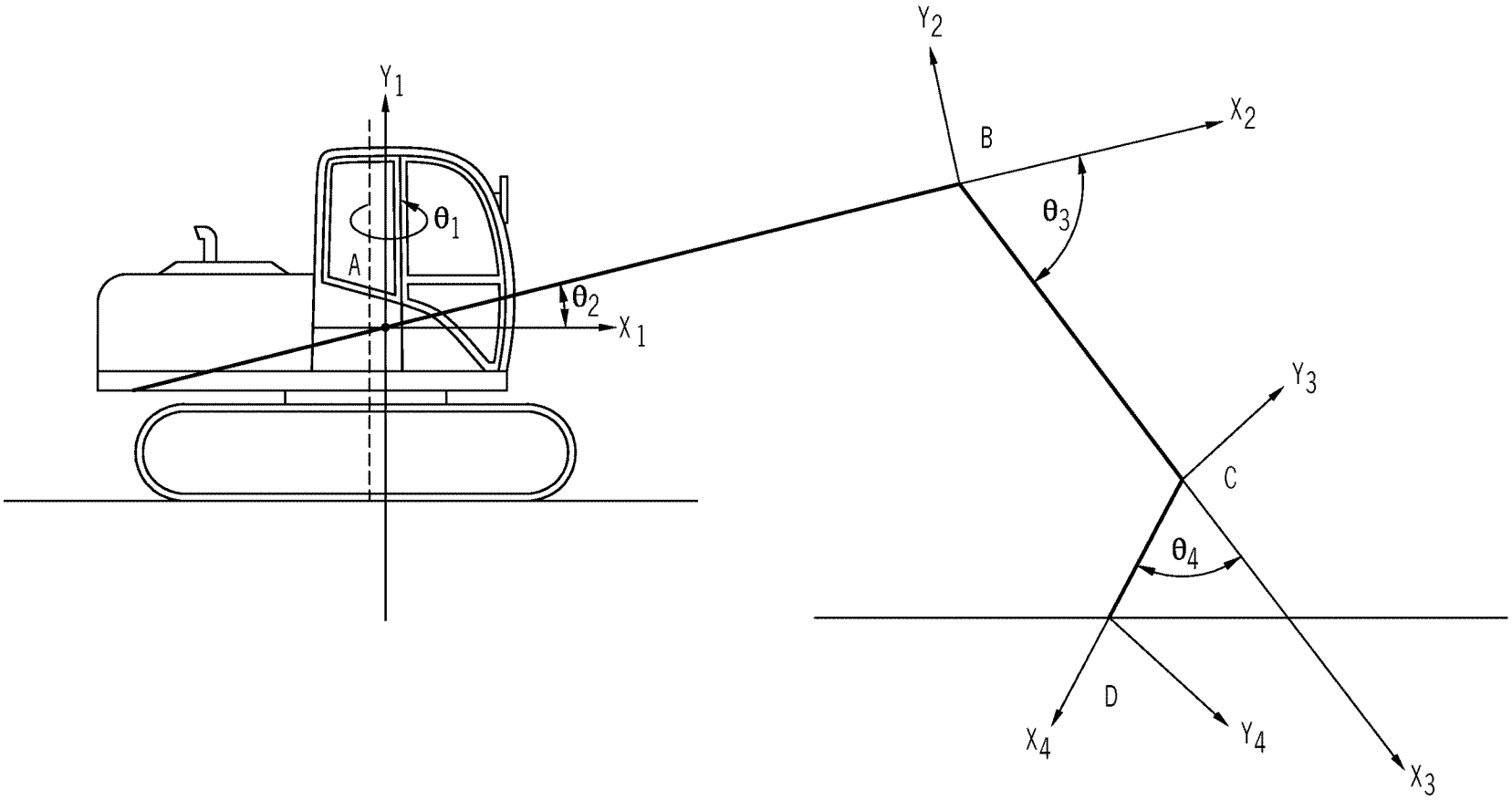
FIG. 8 is a diagram representation of a kinematic model of an excavation vehicle, in accordance with the disclosed embodiments.

The relationships shown in FIG. 7, and computed using the $A_i$ matrix above, may be utilized in calculating angular positions associated with the component parts of an excavation vehicle. FIG. 8 illustrates an excavation vehicle, and angular positions for each of the component parts. As shown (and as described above with respect to FIG. 3), angle $\theta_1$ is a swing angle for the cab around a y-axis, angle $\theta_2$ is the boom angle, angle $\theta_3$ is the stick angle, and angle $\theta_4$ is the angle of the bucket. A homogeneous transformation matrix to relate the two adjacent reference frames shown in FIG. 8 is below:

$$A_{i-1}^{(i)} = \begin{bmatrix} \cos\theta_i & -\cos\alpha_i\sin\theta_i & \sin\alpha_i\sin\theta_i & a_i\cos\theta_i \\ \sin\theta_i & \cos\alpha_i\cos\theta_i & -\sin\alpha_i\cos\alpha_i & a_i\sin\theta_i \\ 0 & \sin\alpha_i & \cos\alpha_i & d_i \\ 0 & 0 & 0 & 1 \end{bmatrix}$$

Here, $a_i$, $a_i$, $d_i$, and $\theta_i$ are the structural kinematic parameters for the links i=1, 2, 3, 4; is the link twist angle; $a_1$, $a_2$, $a_3$, and $a_4$ are lengths of the swing link, boom, arm, and bucket, respectively; and $d_i$=0 because all joints are revolute joints. Homogeneous transformation matrices, using applicable values, are shown below:

$$A_0^{(1)} = \begin{bmatrix} \cos\theta_1 & -\sin\theta_1 & 0 & a_1\cos\theta_1 \\ \sin\theta_1 & \cos\theta_1 & 0 & a_1\sin\theta_1 \\ 0 & 0 & 1 & 0 \\ 0 & 0 & 0 & 1 \end{bmatrix}$$

$$A_1^{(2)} = \begin{bmatrix} \cos\theta_2 & -\sin\theta_2 & 0 & a_2\cos\theta_2 \\ \sin\theta_2 & \cos\theta_2 & 0 & a_2\sin\theta_2 \\ 0 & 0 & 1 & 0 \\ 0 & 0 & 0 & 1 \end{bmatrix}$$

$$A_2^{(3)} = \begin{bmatrix} \cos\theta_3 & -\sin\theta_3 & 0 & a_3\cos\theta_3 \\ \sin\theta_3 & \cos\theta_3 & 0 & a_3\sin\theta_3 \\ 0 & 0 & 1 & 0 \\ 0 & 0 & 0 & 1 \end{bmatrix}$$

$$A_{i-1}^{(i)} = \begin{bmatrix} \cos\theta_i & -\cos\alpha_i\sin\theta_i & \sin\alpha_i\sin\theta_i & a_i\cos\theta_i \\ \sin\theta_i & \cos\alpha_i\cos\theta_i & -\sin\alpha\cos\alpha_i & a_i\sin\theta_i \\ 0 & \sin\alpha_i & \cos\alpha_i & d_i \\ 0 & 0 & 0 & 1 \end{bmatrix}$$

$$A_3^{(4)} = \begin{bmatrix} \cos\theta_4 & -\sin\theta_4 & 0 & a_4\cos\theta_4 \\ \sin\theta_4 & \cos\theta_4 & 0 & a_4\sin\theta_4 \\ 0 & 0 & 1 & 0 \\ 0 & 0 & 0 & 1 \end{bmatrix}$$

During excavation (i.e., digging), the cab swing angle $\theta_1$=0, and the transformation matrix is as follows:

$$A_0^{(1)} = \begin{bmatrix} 1 & 0 & 0 & a_1 \\ 0 & 1 & 0 & 0 \\ 0 & 0 & 1 & 0 \\ 0 & 0 & 0 & 1 \end{bmatrix}$$

Movements of the excavator mechanism during digging occur in a vertical plane, and forward kinematics is used to find any point X, Y, Z using known values for $\theta_2$, $\theta_3$, and $\theta_4$. Inverse kinematics is used to determine the required values for $\theta_2$, $\theta_3$, and $\theta_4$, for a desired coordinate point on the Cartesian coordinate system. The forward kinematic relation for the bucket tip position on the fourth plane ($O_4$) is as follows:

$$P_0^{O_4} = A_0^1 A_1^2 A_2^3 A_3^4 P_4^{O_4} = \begin{bmatrix} c_1(a_4c_{234} + a_3c_{23} + a_2c_2 + a_1) \\ s_1(a_4c_{234} + a_3c_{23} + a_2c_2 + a_1) \\ a_4s_{234} + a_3s_{23} + a_2s_2 \\ 1 \end{bmatrix}$$

=0 when $\theta_1$=0, where $c_i$=cos $\theta_i$, $s_i$=sin $\theta_i$, $\theta_{23}=\theta_2+\theta_3$, and $\theta_{234}=\theta_2+\theta_3+\theta_4$.

Simplifying the forward kinematic relation: $C_1 = 1$, $S_1 = 0$, $$a_1 = 0 = \begin{bmatrix} a_2\cos\theta_2 + a_3\cos(\theta_2 + \theta_3) + a_4\cos(\theta_2 + \theta_3 + \theta_4) \\ 0 \\ a_2\sin\theta_2 + a_3\sin(\theta_2 + \theta_3) + a_4\sin(\theta_2 + \theta_3 + \theta_4) \\ 1 \end{bmatrix}$$

The coordinates of the cutting edge of the bucket are calculated with the relations:

$$X_{O_4}=a_2 \cos \theta_2+a_3 \cos(\theta_2+\theta_3)+a_4 \cos(\theta_2+\theta_3+\theta_4)$$

$$Y_{O_4}=a_2 \sin \theta_2+a_3 \sin(\theta_2+\theta_3)+a_4 \sin(\theta_2+\theta_3+\theta_4),$$

where $a_2$=AB, $a_3$=BC, and $a_4$=CD.

Thus, using the measured angular positions of the boom, stick, and bucket, and using the known dimensions of the working equipment, the coordinate position of the cutting edge of the bucket is determined.

Figure 9:
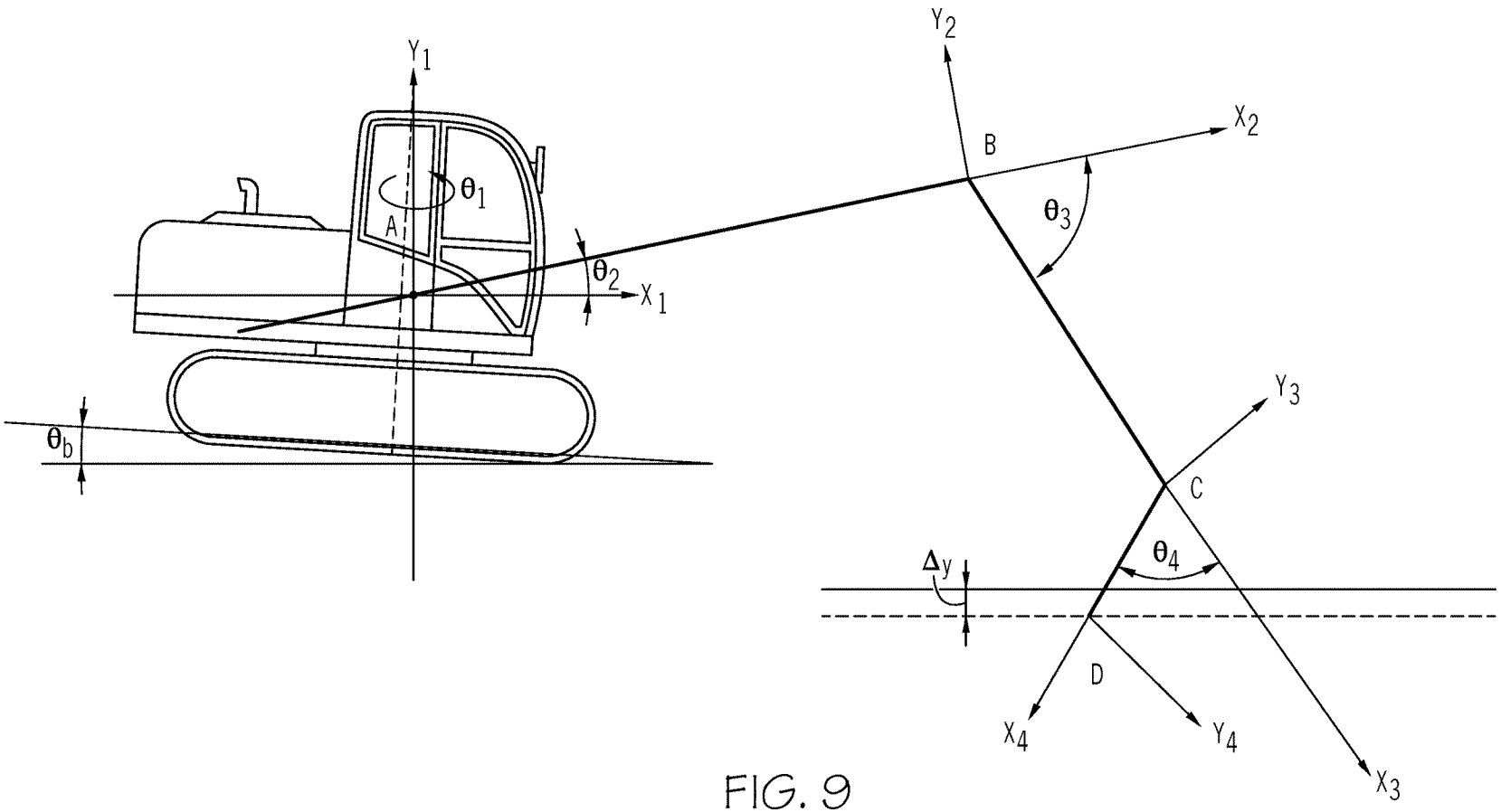
FIG. 9 is another diagram representation a kinematic model of an excavation vehicle, in accordance with the disclosed embodiments.

Returning to FIG. 6, the process 600 then calculates a tilt-compensated coordinate position for the cutting edge of the bucket, based on the current coordinate position and the vehicle tilt angle (step 610). The current coordinate position of the cutting edge of the bucket is calculated as if the excavator vehicle were experiencing no vehicle tilt. Once the current coordinate position of the cutting edge of the bucket has been calculated (step 608), the process 600 uses the same relationships to determine a new coordinate position in the y-axis for the cutting edge of the bucket, and compensates for the detected vehicle tilt value. Tilt-corrected bucket tip position, in the y-axis, is computed using the following equation:

$$Y_{O_4}=a_2 \sin \theta_5+a_3 \sin(\theta_5+\theta_3)+a_4 \sin(\theta_5+\theta_3+\theta_4),$$

where $a_2$=AB, $a_3$=BC, $a_4$=CD, $\theta_b$=inclination (i.e., "tilt") of excavation vehicle, and $\theta_5=\theta_2-\theta_b$. These relationships are shown in FIG. 9, which is an excavator vehicle experiencing vehicle tilt. FIG. 9 also includes the angular positions of the component parts of the excavator vehicle, as described previously with respect to FIGS. 3 and 8.

Returning to FIG. 6, here the process 600 utilizes tilt-compensated position output for the boom to calculate a new coordinate position at which the cutting edge of the bucket of the excavator vehicle may operate effectively and safely. The tilt-compensated coordinates for the cutting edge of the bucket are calculated, based on the current coordinates and either (i) the current boom position and the current vehicle tilt ($\theta_2$ and $\theta_b$); or (ii) a tilt-compensated boom position value ($\theta_5$).

Next, the process 600 computes a tilt-compensated cab position, a tilt-compensated stick position, and a tilt-compensated bucket position, based on the tilt-compensated coordinate position of the cutting edge of the bucket (step 612). Here, the process 600 utilizes the coordinates for the tilt-compensated position of the cutting edge of the bucket to calculate new angular positions at which the cab, the stick, and the bucket of the excavation vehicle may operate effectively and safely. In other words, at the current level of vehicle tilt, the cab, the stick, and the bucket are required to operate within maximum and minimum angular positions, and the most accurate position is computed based on vehicle tilt.

Once the tilt-compensated cab position, the tilt-compensated stick position, and the tilt-compensated bucket position are computed using the required tilt-compensated coordinates for the cutting edge of the bucket, the process 600 then moves the cab, the stick, and the bucket from first positions to the newly-calculated, tilt-compensated positions (step 614) to adjust the position of the excavator vehicle to facilitate effective and safe operation.

Techniques and technologies may be described herein in terms of functional and/or logical block components, and with reference to symbolic representations of operations, processing tasks, and functions that may be performed by various computing components or devices. Such operations, tasks, and functions are sometimes referred to as being computer-executed, computerized, software-implemented, or computer-implemented. In practice, one or more processor devices can carry out the described operations, tasks, and functions by manipulating electrical signals representing data bits at memory locations in the system memory, as well as other processing of signals. The memory locations where data bits are maintained are physical locations that have particular electrical, magnetic, optical, or organic properties corresponding to the data bits. It should be appreciated that the various block components shown in the figures may be realized by any number of hardware, software, and/or firmware components configured to perform the specified functions. For example, an embodiment of a system or a component may employ various integrated circuit components, e.g., memory elements, digital signal processing elements, logic elements, look-up tables, or the like, which may carry out a variety of functions under the control of one or more microprocessors or other control devices.

When implemented in software or firmware, various elements of the systems described herein are essentially the code segments or instructions that perform the various tasks. The program or code segments can be stored in a processor-readable medium or transmitted by a computer data signal embodied in a carrier wave over a transmission medium or communication path. The "computer readable medium", "processor-readable medium", or "machine-readable medium" may include any medium that can store or transfer information. Examples of the processor-readable medium include an electronic circuit, a semiconductor memory device, a ROM, a flash memory, an erasable ROM (EROM), a floppy diskette, a CD-ROM, an optical disk, a hard disk, a fiber optic medium, a radio frequency (RF) link, or the like. The computer data signal may include any signal that can propagate over a transmission medium such as electronic network channels, optical fibers, air, electromagnetic paths, or RF links. The code segments may be downloaded via computer networks such as the Internet, an intranet, a LAN, or the like.

For the sake of brevity, conventional techniques related to signal processing, data transmission, signaling, network control, and other functional aspects of the systems (and the individual operating components of the systems) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in an embodiment of the subject matter.

Some of the functional units described in this specification have been referred to as "modules" in order to more particularly emphasize their implementation independence. For example, functionality referred to herein as a module may be implemented wholly, or partially, as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices, or the like. Modules may also be implemented in software for execution by various types of processors. An identified module of executable code may, for instance, comprise one or more physical or logical modules of computer instructions that may, for instance, be organized as an object, procedure, or function. Nevertheless, the executables of an identified module need not be physically located together, but may comprise disparate instructions stored in different locations that, when joined logically together, comprise the module and achieve the stated purpose for the module. A module of executable code may be a single instruction, or many instructions, and may even be distributed over several different code segments, among different programs, and across several memory devices. Similarly, operational data may be embodied in any suitable form and organized within any suitable type of data structure. The operational data may be collected as a single data set, or may be distributed over different locations including over different storage devices, and may exist, at least partially, merely as electronic signals on a system or network.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. A method for correcting a position of an excavation vehicle, the excavation vehicle comprising a cab, a boom, a stick, and a bucket, the method comprising:

obtaining angular position data for working equipment of the excavation vehicle, wherein the working equipment comprises the cab, the boom, the stick, and the bucket, and wherein angular position data comprises vehicle tilt angle data;

calculating tilt-compensated positions for the working equipment based on the angular position data and dimensions of the working equipment, calculating a tilt-compensated position output for the boom based on the tilt-compensated positions; and adjusting the position of the excavation vehicle based on the tilt-compensated position output, wherein adjusting the position of the excavation vehicle comprises shifting the working equipment to the calculated tilt-compensated positions.

2. The method of claim 1, wherein the adjusting step further comprises correcting a cab position, a boom position, a stick position, and a bucket position.

3. The method of claim 1, wherein the calculating step further comprises:

computing a current coordinate position for a cutting edge of the bucket, based on the angular position data and the dimensions;

computing a tilt-compensated coordinate position for the cutting edge of the bucket, based on the current coordinate position and the vehicle tilt angle data;

wherein the tilt-compensated positions for the working equipment are calculated using the tilt-compensated coordinate position for the cutting edge of the bucket.

4. The method of claim 1, wherein the angular position data is obtained via a cab position sensor, a boom position sensor, a stick position sensor, and a bucket position sensor.

5. The method of claim 4, wherein the vehicle tilt angle data is detected via a vehicle tilt sensor; and wherein the boom position sensor comprises the vehicle tilt sensor as an integrated element.

6. The method of claim 1, wherein the calculating step further comprises:

identifying the current boom angle; and subtracting a forward vehicle tilt angle from the current boom angle and adding a backward vehicle tilt angle to the current boom angle, to create a second boom angle;

wherein the tilt-compensated position output comprises at least the second boom angle.

7. The method of claim 1, wherein the tilt-compensated position output comprises a tilt-corrected boom angle signal and a vehicle tilt signal; and wherein the method further comprises:

communicating the tilt-corrected boom angle signal via a first frequency and communicating the vehicle tilt signal via a second frequency; and utilizing a dual frequency pulse width modulation (PWM) signal to transmit the first frequency and the second frequency.

8. The method of claim 1, wherein the tilt-compensated position output comprises the current boom angle and the vehicle tilt angle data; and wherein the method further comprises:

communicating the current boom angle via a first frequency and communicating the vehicle tilt angle data via a second frequency; and utilizing a dual frequency pulse width modulation (PWM) signal to transmit the first frequency and the second frequency.

9. The method of claim 1, further comprising providing an output diagnostics signal when the excavation vehicle begins operating outside of a specified safety limit.

10. A system for correcting position of an excavation vehicle, the excavation vehicle comprising a cab, a boom, a stick, and a bucket, the system comprising:

at least one processor;

a memory;

a position detection module stored in the memory and, when executed on the at least one processor, configures the at least one processor to: detect angular positions for component parts of the excavation vehicle, the component parts comprising the boom, the stick, and the bucket, wherein the angular positions comprise a current boom angle and a current vehicle tilt angle:

a position analysis module stored in the memory and, when executed on the at least one processor, configures the at least one processor to:

calculate tilt-compensated positions for the component parts based on the angular positions and dimension data for the component parts, and calculate tilt-corrected position data for the boom based on the angular positions including the current boom angle and the current vehicle tilt angle; and a position correction module stored in the memory and, when executed on the at least one processor, configures the at least one processor to initiate adjustment of the position of the excavation vehicle based on the tilt-corrected position data for the boom, wherein adjustment of the position of the excavation vehicle comprises a shift of the component parts to the tilt-compensated positions.

11. The system of claim 10, wherein the position analysis module further configures the processor to:

compute a current coordinate position for a cutting edge of the bucket based on the angular positions and the dimension data; and compute a tilt-compensated coordinate position for the cutting edge of the bucket based on the current coordinate positioned the current vehicle tilt angle;

wherein the tilt-compensated positions for the component parts are calculated using the tilt-compensated coordinate position for the cutting edge of the bucket.

12. The system of claim 10, further comprising:

an output module stored in the memory and, when executed on the at least one processor, configures the at least one processor to transmit the tilt-corrected position data and vehicle tilt data.

13. The system of claim 12, wherein the output module further configures the at least one processor to transmit a dual frequency PWM signal to convey the tilt-corrected position data via a first frequency and the vehicle tilt data via a second frequency.

14. The system of claim 12, wherein the output module further configures the at least one processor to transmit a warning signal when the excavation vehicle operates outside of a specified safety limit.

15. A boom tilt device associated with correcting position of an excavation vehicle comprising a cab, a boom, a stick, and a bucket, the boom tilt device comprising:

a vehicle tilt sensor configured to detect a vehicle tilt angle;

a boom angle position sensor, configured to detect a boom angle position;

processing logic stored in a memory, and when executed upon at least one processor, configures the processor to:

identify dimension data associated with parts of the excavation vehicle, the parts comprising the cab, the boom, the bucket, and the stick; and calculate a tilt-compensated boom position output based on the vehicle tilt angle and the boom angle position; and a boom control element stored in a memory, and when executed upon at least one processor, configures the processor to shift the boom based on the tilt-compensated boom position output.

16. The boom tilt device of claim 15, further comprising a communication interface configured to transmit at least the tilt-compensated boom position output.

17. The boom tilt device of claim 16, wherein the communication interface is further configured to transmit a boom angle data signal and a vehicle tilt data signal via a dual-frequency pulse width modulation (PWM) output signal; and wherein the tilt-compensated boom position output comprises the boom angle data signal and the vehicle tilt data signal.

18. The boom tilt device of claim 16, wherein the communication interface is further configured to transmit a diagnostics signal when the excavation vehicle begins to operate outside a specified safety limit.

19. The boom tilt device of claim 15, further comprising one or more sensors associated with the cab, the stick, or the bucket, wherein the one or more sensors are configured to detect an angular position of the cab, the stick, or the bucket, wherein the tilt-compensated boom position output is based, at least in part, on the detected angular position of the cab, the stick, or the bucket.

* * * * *